United States Patent [19]

Schönwald

[11] 4,141,674

[45] Feb. 27, 1979

[54] IMPELLER FOR A RING COMPRESSOR

[75] Inventor: Siegfried Schönwald, Bad Neustadt, Fed. Rep. of Germany

[73] Assignee: Siemens Aktiengesellschaft, Munich, Fed. Rep. of Germany

[21] Appl. No.: 764,426

[22] Filed: Jan. 31, 1977

Related U.S. Application Data

[63] Continuation-in-part of Ser. No. 549,781, Feb. 13, 1975, abandoned.

[51] Int. Cl.[2] ..... F01D 5/02

[52] U.S. Cl. ..... 416/223 A; 416/184; 415/53 T

[58] Field of Search ..... 416/223, 184, 223 A; 415/53 T, 213 T

[56] References Cited

U.S. PATENT DOCUMENTS

| | | | |
|---|---|---|---|
| 2,003,350 | 6/1935 | Durdin | 416/184 X |
| 3,257,955 | 6/1966 | Worst | 416/184 X |
| 3,788,766 | 1/1974 | Engels | 415/213 T X |
| 3,942,906 | 3/1976 | Schonwald | 415/53 T |
| 3,973,865 | 8/1976 | Mugele | 415/213 T X |
| 3,982,848 | 9/1976 | Schonwald et al. | 415/213 T X |
| 4,006,998 | 2/1977 | Schonwald | 415/213 T |

FOREIGN PATENT DOCUMENTS

| | | | |
|---|---|---|---|
| 499484 | 6/1930 | Fed. Rep. of Germany | 415/53 T |
| 1331429 | 5/1963 | France | 415/213 T |
| 316250 | 11/1956 | Switzerland | 416/223 |
| 606127 | 8/1948 | United Kingdom | 415/53 T |
| 370369 | 4/1973 | U.S.S.R. | 415/53 T |
| 436174 | 12/1974 | U.S.S.R. | 415/53 T |

*Primary Examiner*—Everette A. Powell, Jr.
*Attorney, Agent, or Firm*—Kenyon & Kenyon, Reilly, Carr & Chapin

[57] ABSTRACT

An improved rotor for a side-channel compressor in which the ratio of the pressure of the compressor at zero output and the suction pressure of the compressor is greater than or equal to 1.79 and which rotor includes a plurality of spaced-apart blades having cells interposed therebetween. The improvement of the invention comprises the blades having a thickness dimension chosen so that the ratio of the blade cell volume to the sum of the blade cell volume and the blade volume is a maximum value of 0.72 and a minimum value of $0.45/(p_{max}/p_1-1)^2$.

1 Claim, 3 Drawing Figures

IMPELLER FOR A RING COMPRESSOR

BACKGROUND OF THE INVENTION

This application is a continuation-in-part of application Ser. No. 549,781, filed on Feb. 13, 1975 now abandoned, for "Impeller for a Ring compressor".

1. Field of the Invention

The present invention relates generally to side-channel compressors, and in particular to an improved blade construction for the rotor of a side-channel compressor.

2. Description of the Prior Art

When a side-channel compressor is utilized to compress gases to high pressure ratios, the compressibility of the gas adversely affects the operation of the compressor. Specifically, the gas compressed into the blade cells of the rotor, i.e., the regions between the rotor blades, is dragged across the interrupter or break between the inlet and outlet openings of the side channel of the compressor. The compressed gas then expands on the suction, i.e., inlet, side of the compressor into the side channel, thereby reducing the useful draw-in transport flow which, in turn, limits the attainable efficiency of the compressor.

SUMMARY OF THE INVENTION

It is therefore an object of the present invention to overcome the aforementioned disadvantages of heretofore known side-channel compressors and to provide an improved rotor for such compressors.

These and other objects of the invention are achieved in a rotor for a side-channel compressor in which the ratio of the pressure of the compressor at zero output, $p_{max}$, to the suction pressure of the compressors, $p_1$, is greater than or equal to 1.79, and which rotor includes a plurality of spaced-apart blades having cells interposed therebetween. The improvement of the invention comprises the blades having a thickness dimension chosen so that the ratio of (a) the blade cell volume to (b) the sum of the blade cell volume and the blade volume is equal to or less than 0.72 and greater than or equal to $0.45/(p_{max}/p_1-1)^2$.

The present invention is based on the discovery that the reduction of the efficiency of the compressor becomes smaller in magnitude as the gas volume dragged across the interrupter or break of the compressor becomes smaller. This, in turn, means that the volume of the blade cells should be kept as small as possible, which can be accomplished by increasing the thickness of the rotor blades. In designing the rotor, the blade thickness is considered in calculating the ratio t of the blade cell volume to the sum of the blade cell volume and the blade volume, i.e., $t = V_Z/(V_z + V_s)$. Since heretofore it was the opinion of persons skilled in the art that rotor blades constructed as thin as possible yielded a high pressure in side-channel compressors, values for t of 0.75 and higher were provided for such compressors.

In contrast, the present invention specifies that the dimension of the blade thickness is to be chosen so that the value of the ratio t ranges between an upper maximum limit of 0.72 and a lower minimum limit given by the equation $t_{min} = 0.45/(p_{max}/p_1-1)^2$. Because of the smaller value of the ratio t in the invention, the pressure produced in the side channel of the compressor is somewhat less than that which would be produced with larger values for the ratio t. This reduction in pressure is, however, more than compensated for by a reduction of the volume flow loss dragged across the interrupter of the compressor produced by the invention to a degree more than the reduction of the transport flow in the side channel of the compressor. This effect is dependent upon the ratio of the pressure reached at zero output, i.e., complete throttling of the pump flow, $p_{max}$, and the suction pressure of the compressor, $p_1$. This pressure ratio must be relatively high and accordingly determination of the ratio t in the present invention is applicable to side-channel compressors in which the pressure ratio of $p_{max}$ to $p_1$ is greater than or equal to 1.79.

These and other novel features and advantages of the present invention will be described in greater detail in the following detailed description.

BRIEF DESCRIPTION OF THE DRAWINGS

In the drawings, wherein similar reference characters denote similar elements throughout the several views thereof.

DETAILED DESCRIPTION

Figure 1:
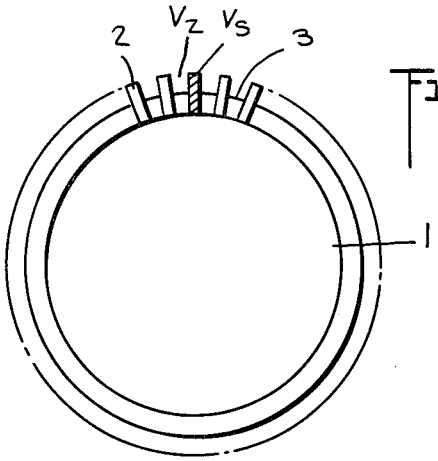
FIG. 1 is a schematic illustration of an improved rotor for a side-channel compressor constructed according to the present invention.
Figure 2:
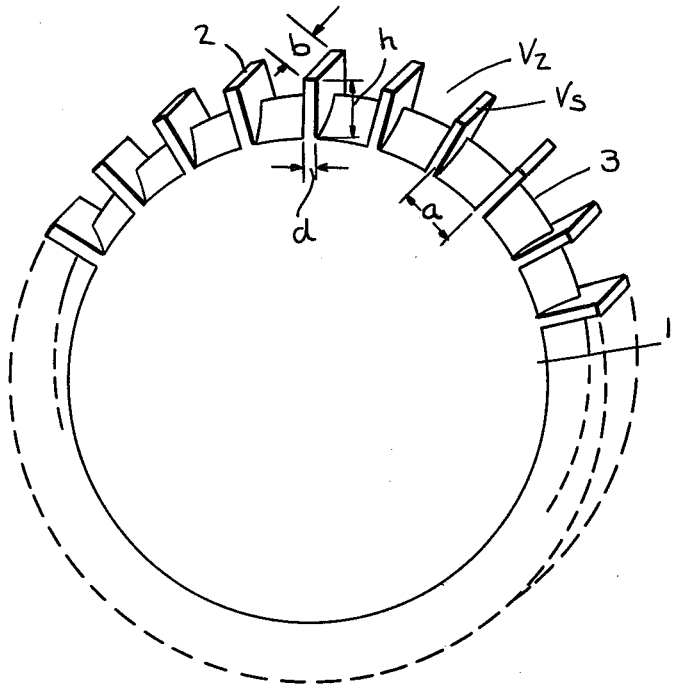
FIG. 2 is a partial, perspective view of an improved rotor for a side-channel compressor constructed according to the present invention.

Referring now to the drawings, and in particular to FIGS. 1 and 2, there is shown a rotor 1 for a side-channel compressor which includes a plurality of radially outwardly extending blades 2. Each of the blades has a volume, determined by computing the product of the length, width and height of the blades, designated by the reference character $V_s$. Similarly, each of the blade cells, i.e., each of the regions between an adjacent pair of blades, has a volume designated by the reference character $V_z$ and determined in a similar manner. Guide ribs 3 are provided between each pair of blades 2 for deflecting the gas to be pumped by the compressor.

As shown in FIG. 2, blades 2 have an axial width b, a thickness d, and a height h. As previously mentioned, the volume of each blade is obtained by multiplying b, d, and h. The blade cell volume $V_z$ is the volume of the space located between adjacent pairs of blades 2 and likewise is obtained from the product of the axial width b of the blades, the height h of the blades (since the height and axial width of the blade cells is the same as the corresponding dimensions of blades 2), and the distance a between each pair of blades, a being the distance between two blades at one half the height h of the blades. The volume of the guide ribs 3 can be ignored since it enters into th blade volume $V_s$ as well as the blade cell volume $V_z$ in the ratio of the thickness d of the blades to the distance a between each pair of blades.

In designing the rotor for the compressor, the thickness of each of blades 2 is selected so as to realize a value of the ratio t which ranges between an upper limit equal to or smaller than 0.72 and a lower limit greater than or equal to $0.45/(p_{max}/p_1-1)^2$. Such a design produces a small blade cell volume and considerably reduces the gas volume dragged across the break of the compressor between the outlet and inlet openings thereof.

Figure 3:
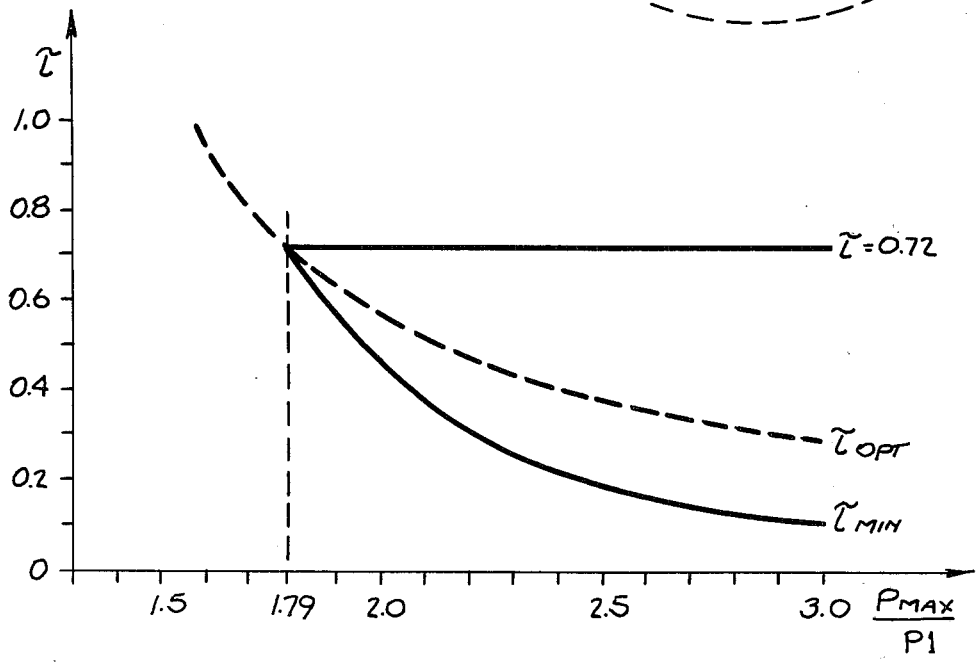
FIG. 3 is a graphical illustration of the ratio t of the blade cell volume to the sum of the blade cell volume and the blade volume versus the ratio of the pressure of the compressor reached at zero output and the suction pressure of the compressor, for an improved rotor for a side-channel compressor constructed according to the present invention.

FIG. 3 of the drawings graphically illustrates values of the ratio t versus the pressure ratio $p_{max}/p_1$ of a side-channel compressor constructed according to the invention. As shown in the drawing, an optimum value for the ratio t is obtained when $t = 0.85\ t_{min}$. Optimum efficiency of the side-channel compressor is obtained when the ratio t is equal to this value.

It has been found that in side-channel compressors embodying the invention, no appreciable reduction of the pressure generation of the compressor takes place. As a result, use of the inventive rotor enables increased efficiency to be obtained compared to prior art compressors in which the ratio t has a value equal to or greater than 0.75.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In a rotor for a side-channel compressor in which the ratio of the pressure at zero output of the compressor, $p_{max}$, and the suction pressure of the compressor, $p_1$, is greater than or equal to 1.79, said rotor including a plurality of spaced-apart blades having cells interposed therebetween, the improvement comprising said blades having a thickness dimension chosen so that the ratio of (a) the blade cell volume to (b) the sum of the blade cell volume and the blade volume is equal to or less than 0.72 and greater than or equal to $0.45/(p_{max}/p_1-1)^2$.

* * * * *